US011822285B2

(12) United States Patent
Abe

(10) Patent No.: US 11,822,285 B2
(45) Date of Patent: Nov. 21, 2023

(54) IMAGE FORMING APPARATUS WITH COOLING FANS POSITIONED RELATIVE TO ARRANGEMENT DIRECTION OF IMAGE FORMING STATIONS

(71) Applicant: CANON KABUSHIKI KAISHA, Tokyo (JP)

(72) Inventor: Hideto Abe, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/837,714

(22) Filed: Jun. 10, 2022

(65) Prior Publication Data

US 2022/0404764 A1 Dec. 22, 2022

(30) Foreign Application Priority Data

Jun. 16, 2021 (JP) ..... 2021-100082

(51) Int. Cl.
*G03G 21/00* (2006.01)
*G03G 21/20* (2006.01)

(52) U.S. Cl.
CPC ... *G03G 21/206* (2013.01); *G03G 2221/1645* (2013.01)

(58) Field of Classification Search
CPC ..... G03G 21/206; G03G 2221/1645
USPC ..... 399/92
See application file for complete search history.

(56) References Cited

U.S. PATENT DOCUMENTS 7,433,624 B2 * 10/2008 Ohkura ..... B41J 2/1752 399/92
2007/0003313 A1 1/2007 Hatakeyama et al. ..... 399/92
2009/0285588 A1 * 11/2009 Furuichi ..... G03G 21/206 399/27
2014/0212164 A1 * 7/2014 Miyagawa ..... G03G 21/206 399/92

(Continued)

FOREIGN PATENT DOCUMENTS

JP 2007-041562 2/2007
JP 2009-025759 2/2009

(Continued)

OTHER PUBLICATIONS

U.S. Appl. No. 17/863,014, filed Jul. 12, 2022.
Extended European Search Report dated Nov. 2, 2022 in counterpart EP Application No. 22173181.3.

*Primary Examiner* — Robert B Beatty
(74) *Attorney, Agent, or Firm* — Venable LLP

(57) ABSTRACT

An image forming apparatus includes first and second image forming units, and first and second fans. The first and second image forming units are positioned on one and the other endmoset sides in an arrangement direction of the plurality of image forming units, respectively. The first and second fans are provided closer on one and the other endmoset side than the first and second image forming units, respectively. A first suction port for supplying outside air to the first fan is positioned closer to the first image forming unit than to the second image forming unit. A second suction port is positioned closer to the second image forming unit than to the first image forming unit. The first fan is positioned closer to the first image forming unit than to the second image forming unit, and the second fan is positioned closer to the second image forming unit than to the first image forming unit.

15 Claims, 12 Drawing Sheets

(56) References Cited

U.S. PATENT DOCUMENTS

| | | | | |
|---|---|---|---|---|
| 2015/0346684 | A1* | 12/2015 | Sasaki | G03G 21/203 399/92 |
| 2016/0342135 | A1 | 11/2016 | Fujiya et al. | G03G 21/20 |
| 2017/0160699 | A1 | 6/2017 | Imanari et al. | G03G 21/2003 |
| 2018/0059601 | A1 | 3/2018 | Abe et al. | |
| 2020/0159142 | A1* | 5/2020 | Omura | G03G 21/0052 |
| 2020/0326654 | A1* | 10/2020 | Mizutani | G03G 21/10 |

FOREIGN PATENT DOCUMENTS

| | | | | |
|---|---|---|---|---|
| JP | 2009-222736 | | 10/2009 | |
| JP | 2009-237195 | | 10/2009 | |
| JP | 2012-068682 | | 4/2012 | |
| JP | 2016-218420 | | 12/2016 | |
| JP | 2021020814 | A * | 2/2021 | B65H 3/14 |
| KR | 2008011040 | A * | 1/2008 | G03G 21/20 |

* cited by examiner

IMAGE FORMING APPARATUS WITH COOLING FANS POSITIONED RELATIVE TO ARRANGEMENT DIRECTION OF IMAGE FORMING STATIONS

FIELD OF THE INVENTION AND RELATED ART

The present invention relates to an image forming apparatus such as a printer, copier, facsimile machine or multi-function printer.

An image forming apparatus has a plurality of image forming portions (also called image forming stations) that form a toner image on a photosensitive drum. In each image forming portion, for example, toner is circulated and fed while being agitated by a feeding screw in the developing unit, and heat is generated in response to this toner agitation operation. However, if the developing unit becomes hot, the temperature of the toner rises, causing image defects and so conventionally the developing unit is cooled by airflow created by outside air sucked in from outside the image forming apparatus by a suction fan (Japanese Laid-Open Patent Application No. 2007-41562).

In the apparatus described in the Japanese Laid-Open Patent Application No. 2007-41562, one suction fan and multiple developing units are connected by a tube-shaped duct. One suction fan guides the outside air sucked in from the suction port provided on one side surface of the device toward the multiple developing units.

In addition, in a charging unit that charges the surface of a photosensitive drum among image forming portions, an air flow may be formed to collect discharge products such as ozone emitted by corona discharge. In the apparatus described in Japanese Laid-Open Patent Application No. 2016-218420, a branch duct is provided to lead the outside air sucked in by the suction fan to the charging unit of each image forming portion, thus allowing the collection of ozone emitted by the charging.

By the way, recently, image forming apparatuses for commercial printing are used, which can form toner images on more recording materials in a shorter time. Compared to office printing equipment and home printing equipment, commercial printing equipment tends to be larger than office printing equipment and home printing equipment because each of the multiple image forming portions mounted in parallel on the casing is larger. In addition, image forming apparatuses for commercial printing generally print faster than those for office printing, and tend to increase the temperature rise in the developing unit and the generation of discharge products in the charging unit, as described above. Such image forming apparatuses with high printing speeds require a higher airflow volume for cooling airflow in the developing unit and for airflow collecting discharge products in the charging unit. Therefore, as in the image forming apparatus described in Japanese Laid-Open Patent Application No. 2007-41562 and Japanese Laid-Open Patent Application No. 2016-218420, it is conceivable to install ducts that connect the outside air sucked from one side surface of the image forming apparatus by the suction fan to multiple developing units and charging units. However, in the case of an image forming apparatus for commercial printing with high printing speed as described above, the apparatus itself is large and requires a large amount of airflow to each image forming portion. Therefore, it is difficult to secure sufficient airflow to the image forming portion at the other end, which is far from the suction port on the one side surface of the image forming apparatus.

In view of the above problem, the present invention aims to provide an image forming apparatus that can suppress insufficient airflow to each image forming portion in a configuration in which air sucked by a suction fan through a duct is guided toward multiple image forming portions.

SUMMARY OF THE INVENTION

According to an aspect of the present invention, there is provided an image forming apparatus for forming an image on a recording material comprising: a first image forming unit, one of a plurality of image forming units, positioned on one endmost side in an arrangement direction of the plurality of image forming units, said first image forming unit including a first photosensitive member, a first charging unit configured to charge said first photosensitive member by corona discharge and a first developing unit configured to develop an electrostatic latent image formed on said first photosensitive member with toner; a second image forming unit, one of the plurality of image forming units, positioned on the other endmost side in the arrangement direction, said second image forming unit including a second photosensitive member, a second charging unit configured to charge said second photosensitive member by corona discharge and a second developing unit configured to develop an electrostatic latent image formed on said second photosensitive member with toner; a first fan provided closer on the one endmost side in the arrangement direction than said first image forming unit, said first fan sucking outside air to supply from a first suction port to said first image forming unit, and the first suction port being positioned closer to said first image forming unit in the arrangement direction than to said second image forming unit; and a second fan provided closer on the other endmost side in the arrangement direction than said second image forming unit, said second fan sucking outside air to supply from a second suction port to said second image forming unit, and the second suction port being positioned closer to said second image forming unit in the arrangement direction than to said first image forming unit; wherein said first fan is positioned closer to said first image forming unit in the arrangement direction than to said second image forming unit, and wherein said second fan is positioned closer to said second image forming unit in the arrangement direction than to said first image forming unit.

Further features of the present invention will become apparent from the following description of exemplary embodiments with reference to the attached drawings.

Figure 3:
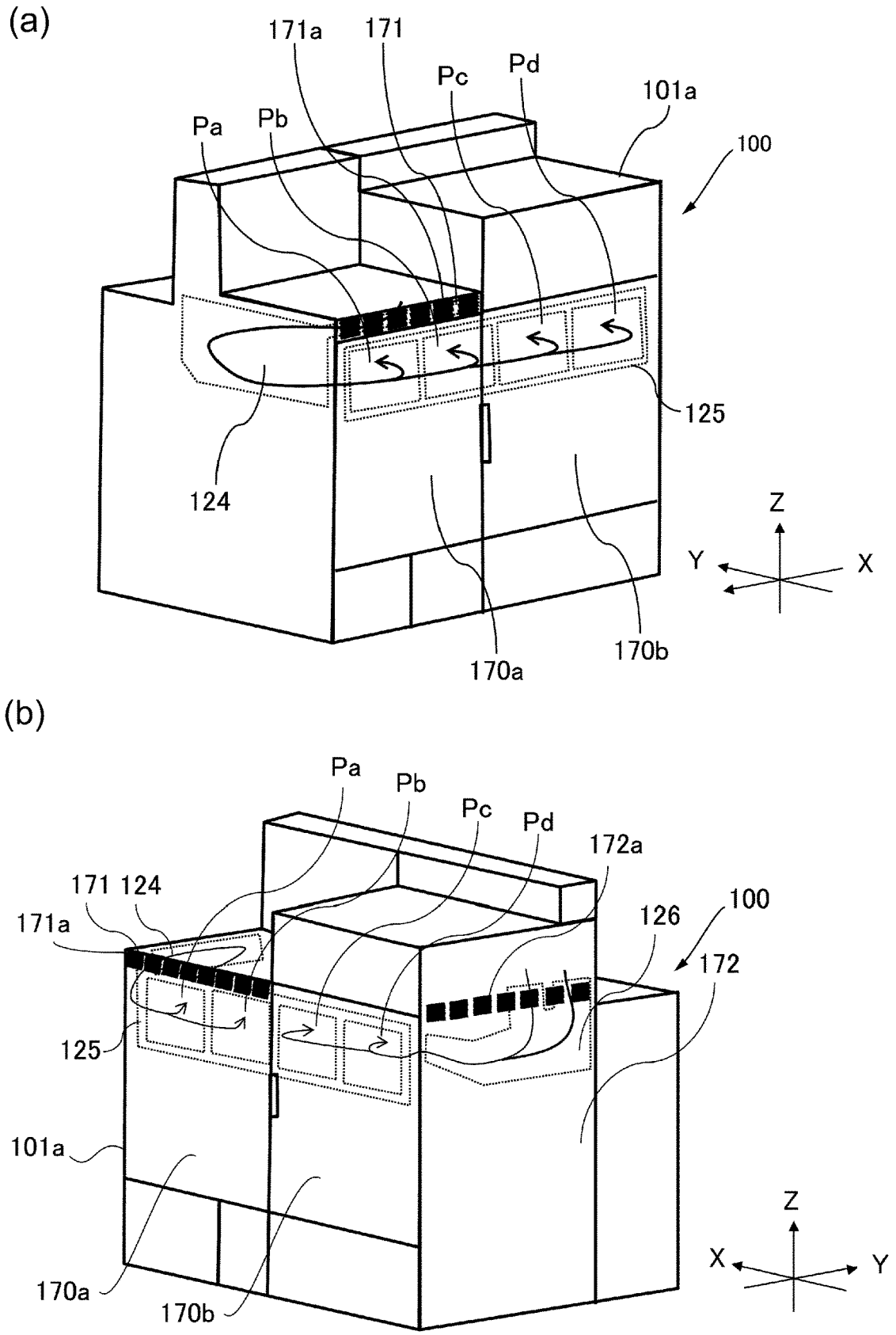

Part (a) of FIG. 3 is a left-side perspective view showing the front door of the image forming apparatus closed, and Part (b) of FIG. 3 is a right-side perspective view showing the front door of the image forming apparatus closed.

Figure 4:
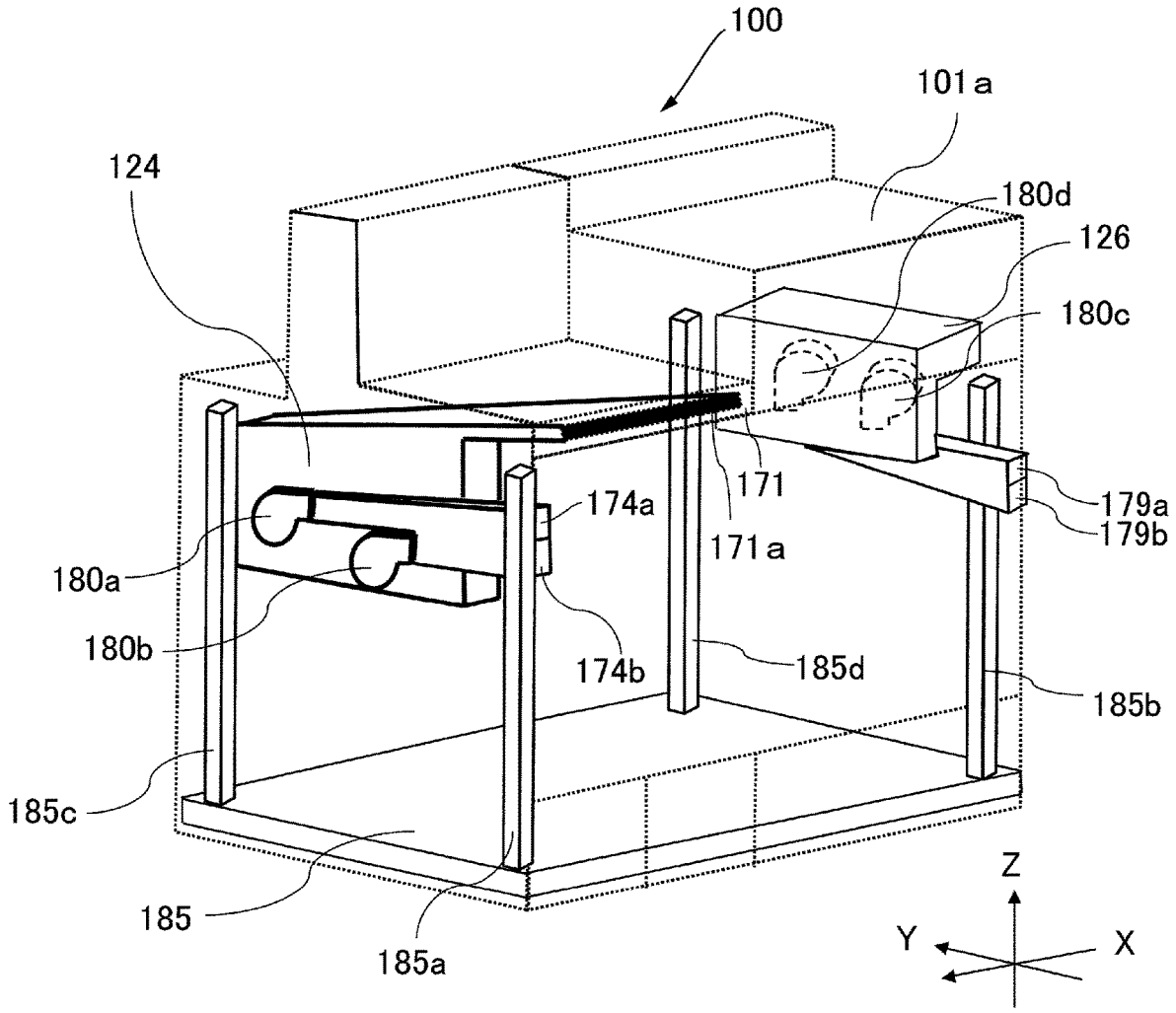

FIG. 4 is a schematic diagram showing the arrangement of the left side suction unit and the right-side suction unit in the first casing.

Figure 5:
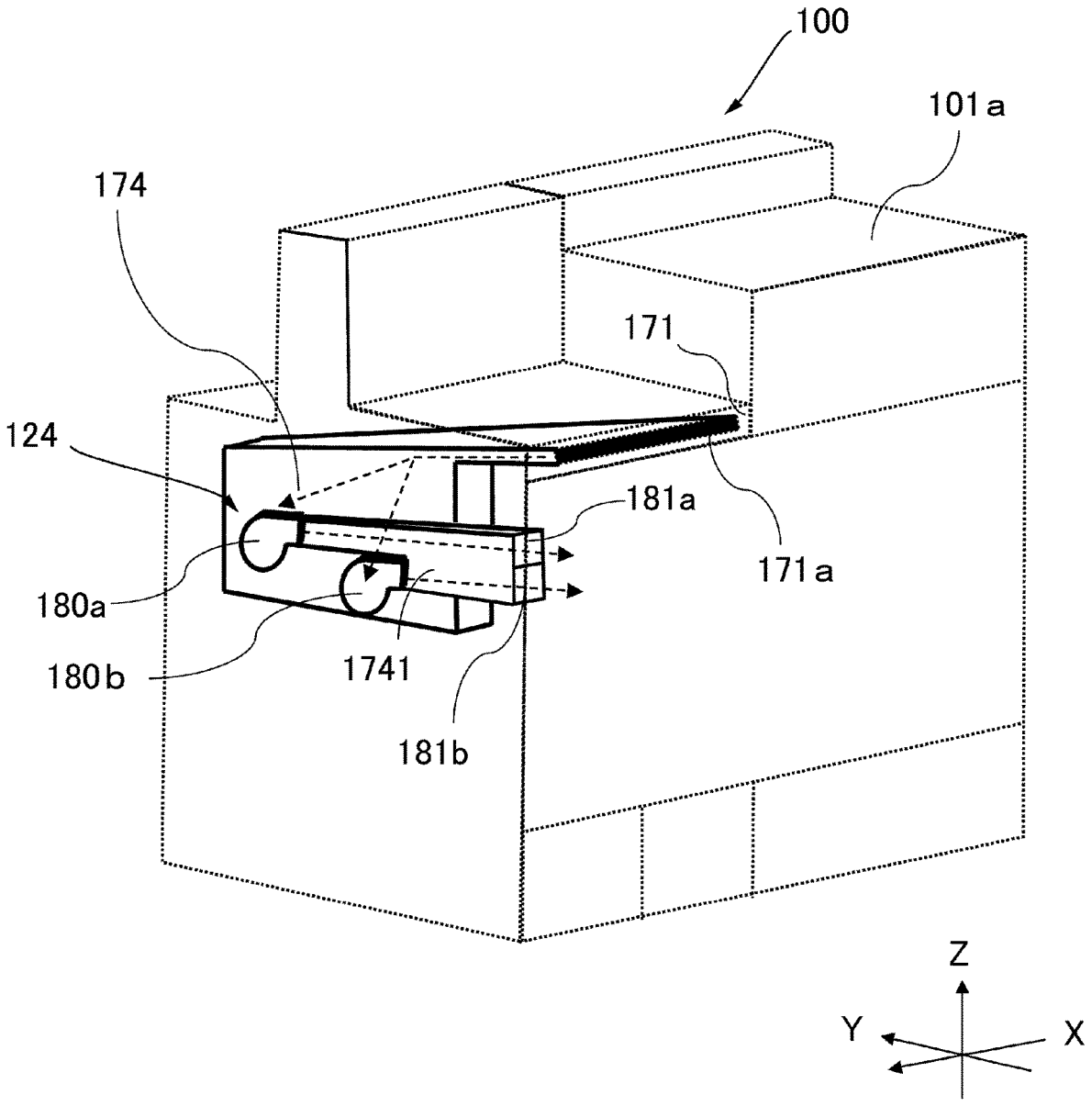

FIG. 5 is a perspective view showing the left side suction unit for air suction to the developing device.

Figure 6:
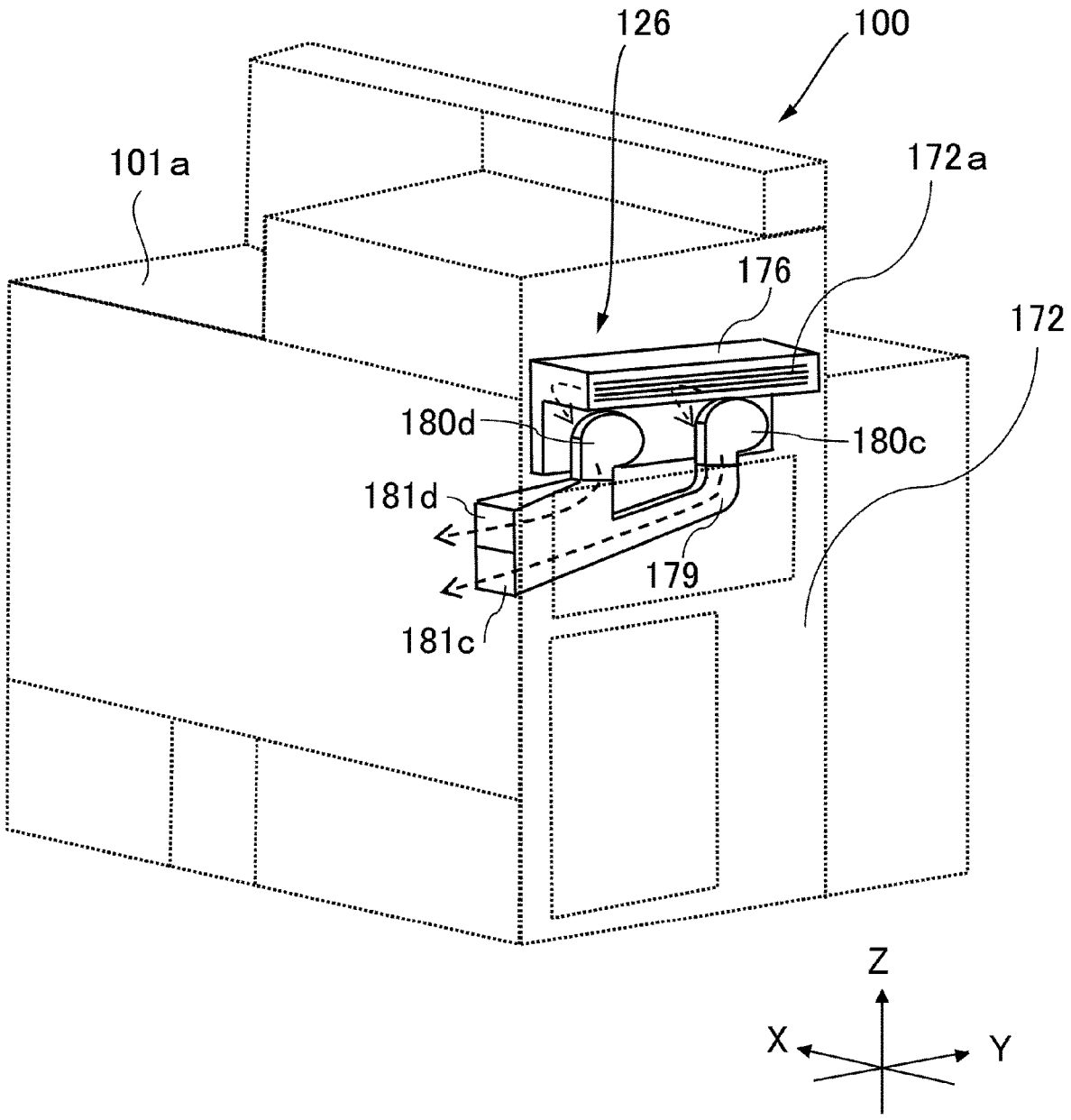

FIG. 6 is a perspective view showing the right-side suction unit for air suction to the developing device.

Figure 7:
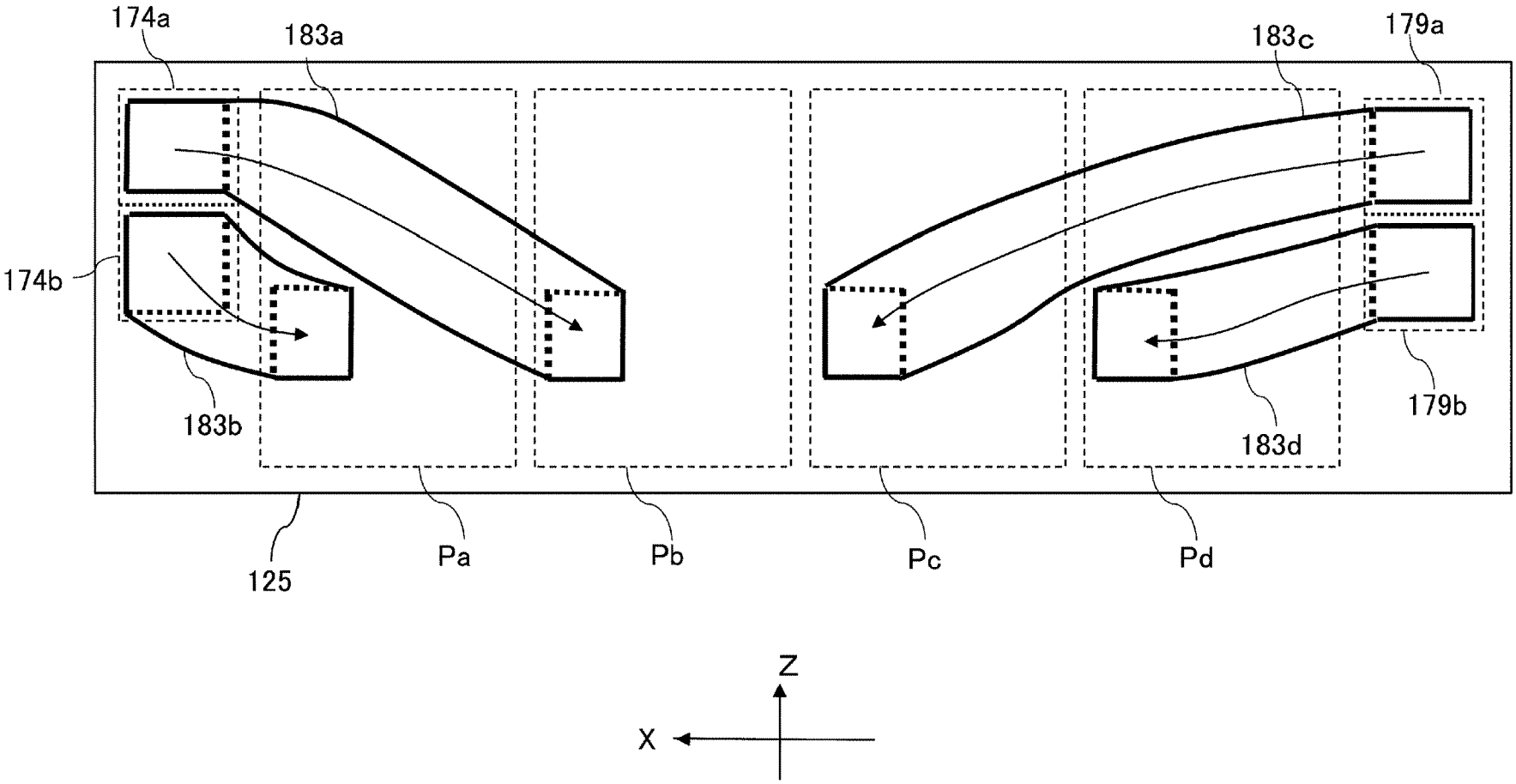

FIG. 7 is a schematic view showing the inner side of the inner cover unit for air suction to the developing device.

Figure 8:
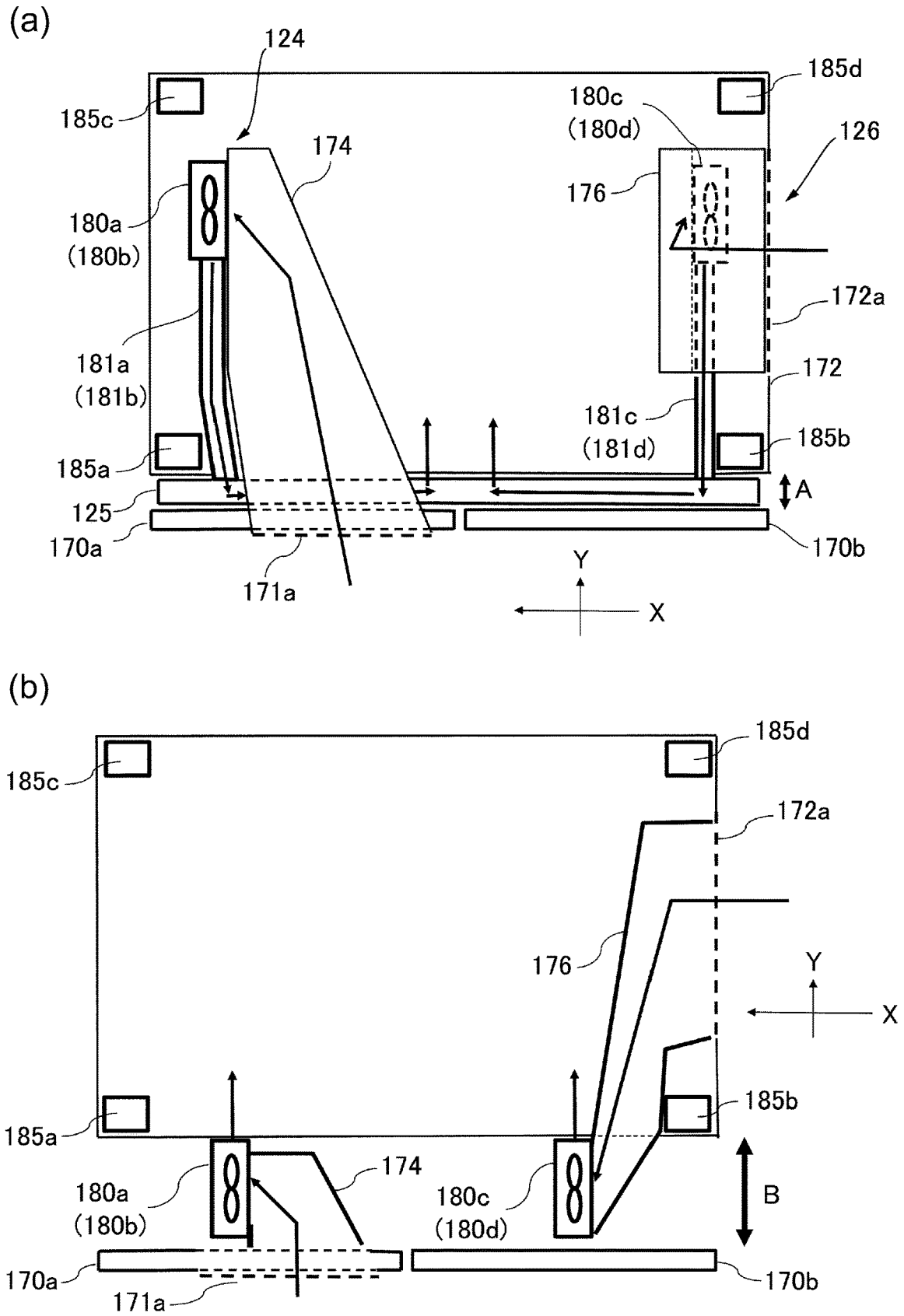

Part (a) of FIG. 8 is a schematic diagram illustrating airflow to the developing device according to the present embodiment, and Part (b) of FIG. 8 is a schematic diagram illustrating airflow to the developing device according to a comparative example.

Figure 9:
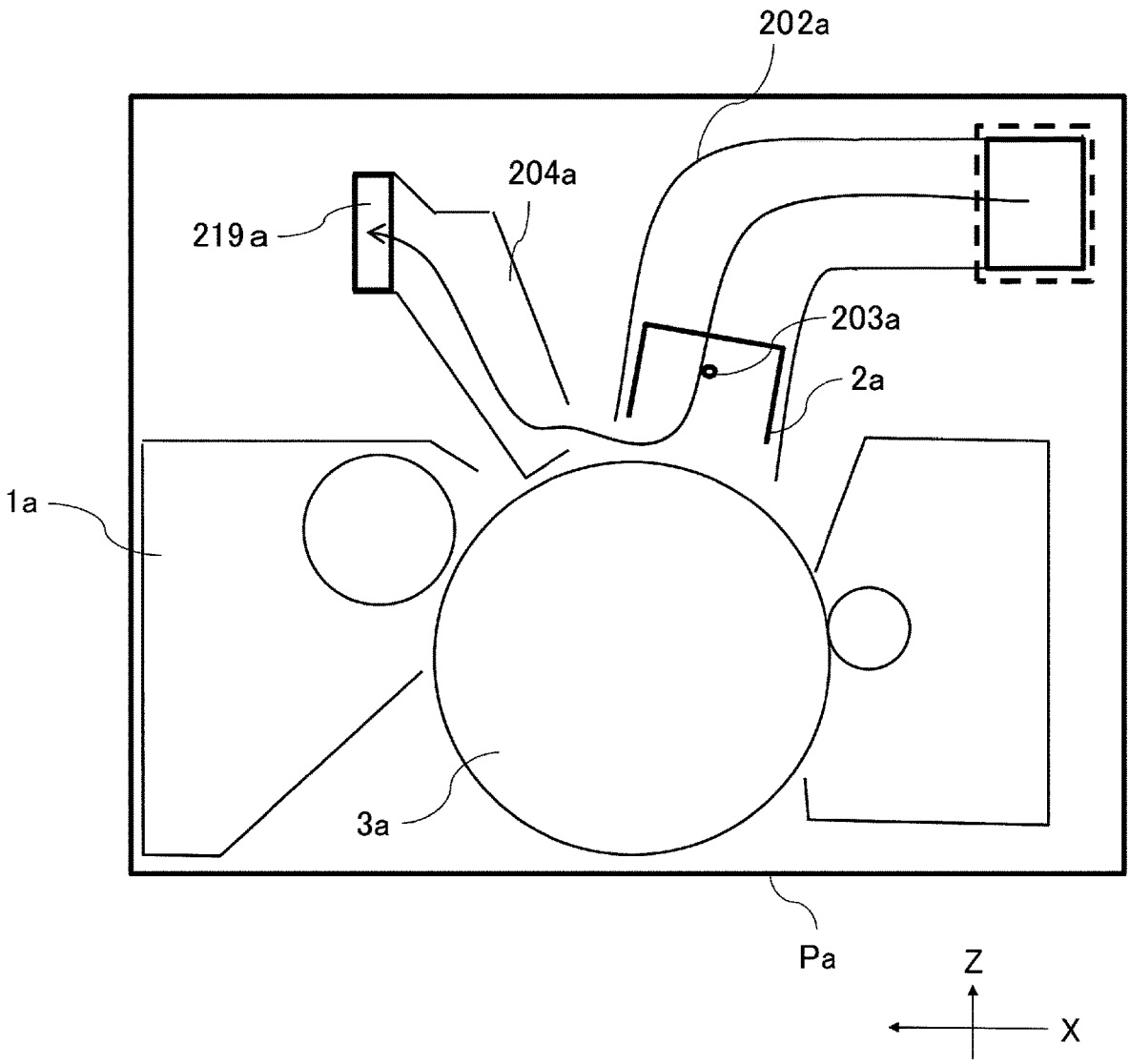

FIG. 9 is a schematic view explaining airflow to the charging device.

Figure 10:
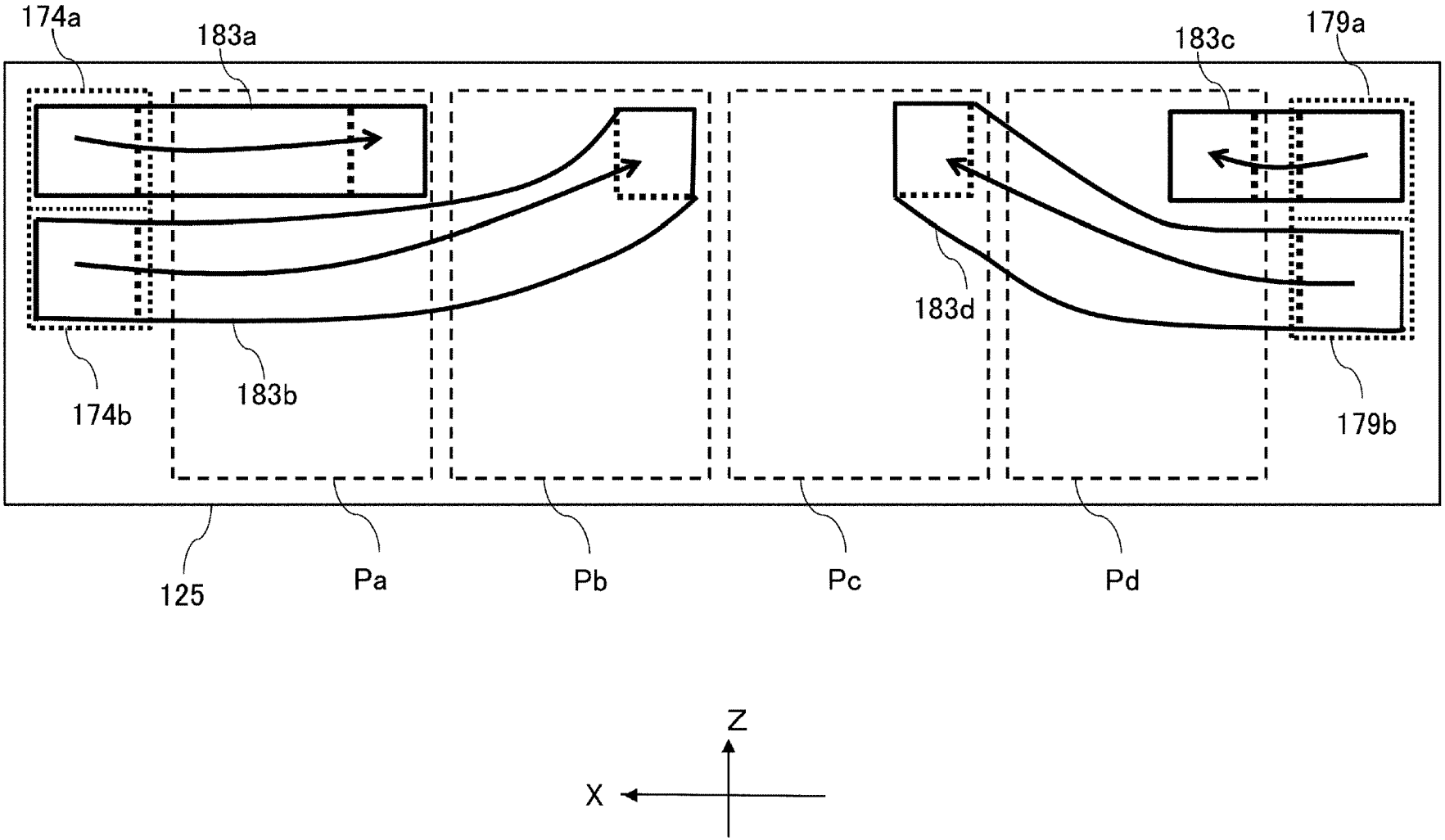

FIG. 10 is a schematic view showing the inner side of the inner cover unit for air suction to a charging device.

Figure 11:
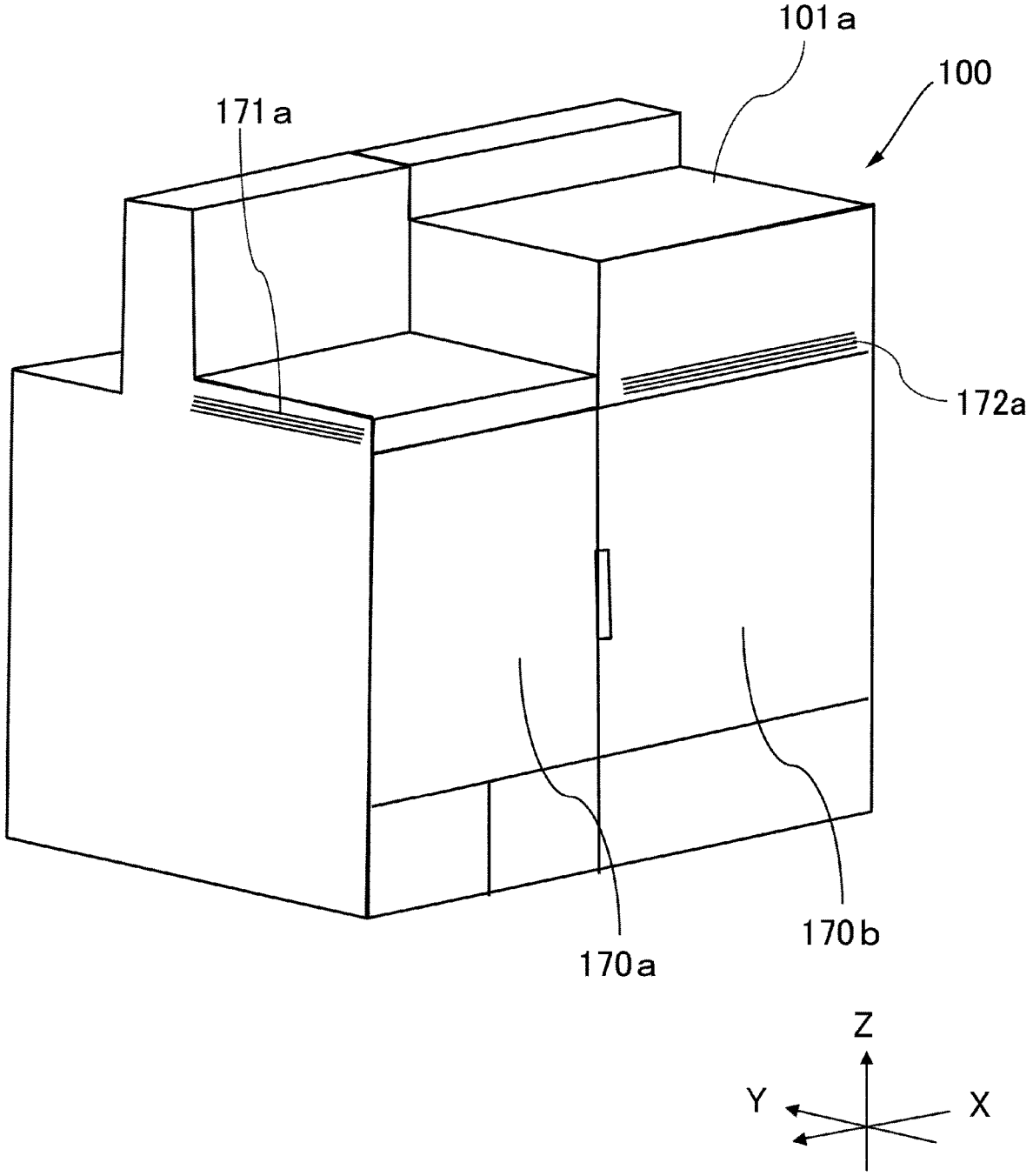

FIG. 11 is a left side perspective view showing a suction port.

Figure 12:
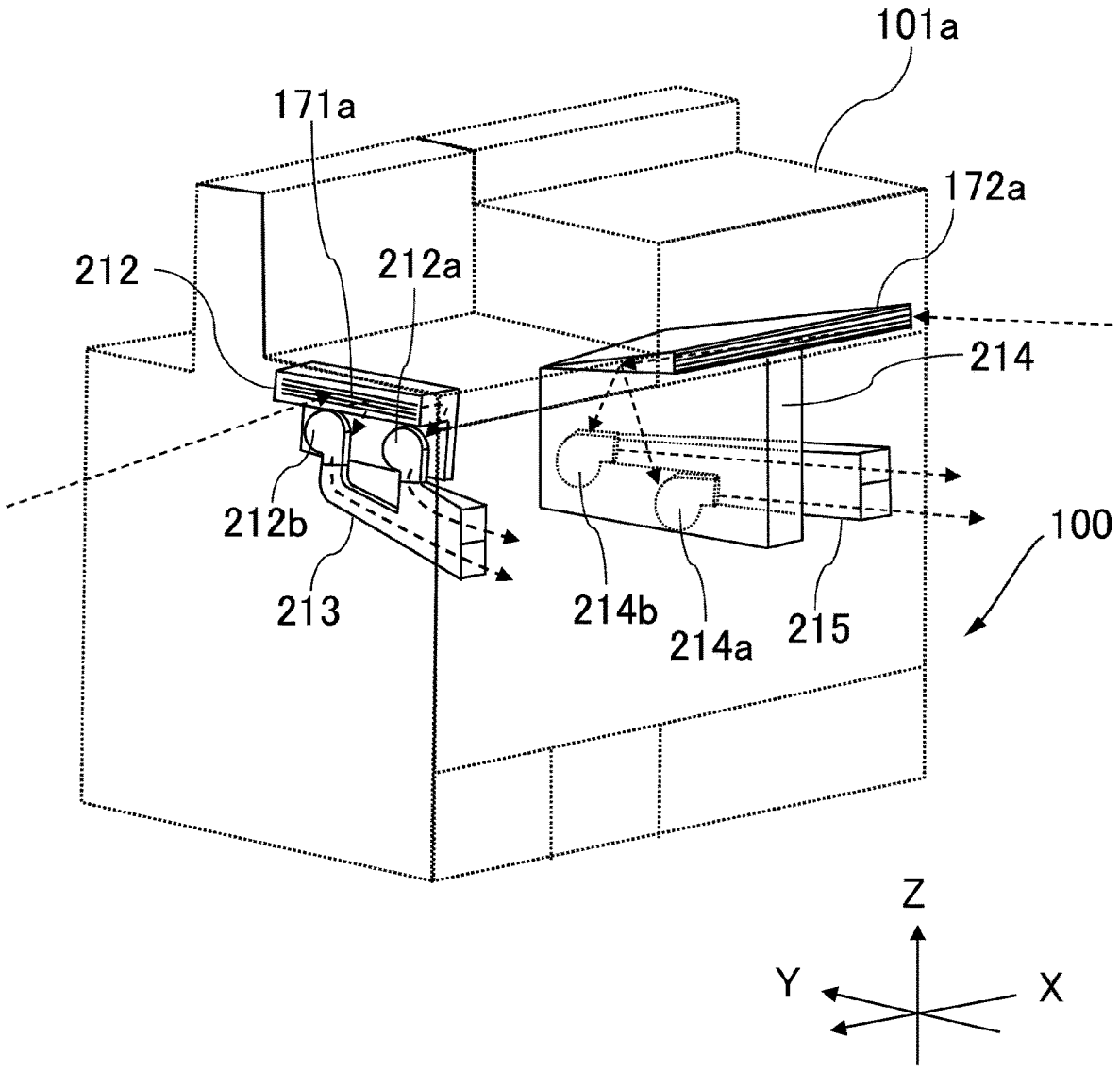

FIG. 12 is a schematic diagram showing a suction unit in the case of FIG. 11.

DESCRIPTION OF THE EMBODIMENTS

First Embodiment

<Image Forming System>

Figure 1:
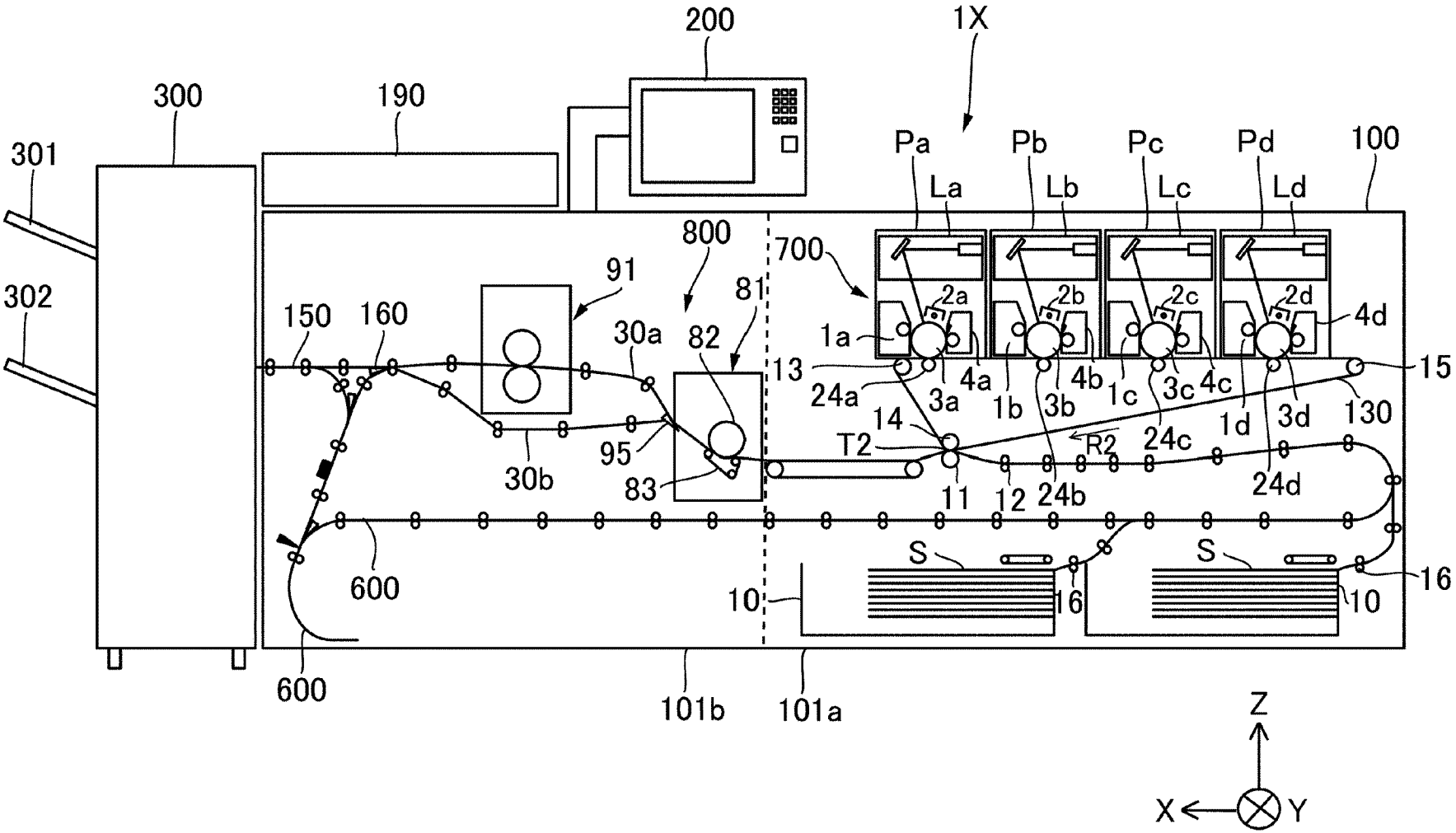
FIG. 1 is a schematic view showing the image forming system with the image forming apparatus according to the present embodiment.

The schematic configuration of an image forming system equipped with an image forming apparatus of the present embodiment is described using FIG. 1. An image forming system 1× shown in FIG. 1 has an image forming apparatus 100 and a finisher device 300. The image forming apparatus 100 and the finisher apparatus 300 are connected so as to be able to receive and deliver a recording material S. The image forming apparatus 100 and the finisher apparatus 300 are connected so as to be able to receive and deliver the recording material S. In the present embodiment, the finisher device 300 is a post-processing unit that can be retrofitted to the image forming apparatus 100 to expand its functionality, and can be used to fix the toner image fixed by the image forming apparatus 100. The post-processing described below can be performed on the recording material S. The image forming apparatus 100 and the finisher device 300 are connected through a communication interface capable of serial or parallel communication to enable data transmission and reception between them.

<Image Forming Apparatus>

The image forming apparatus 100 is an electrophotographic tandem-type full-color printer that has a first casing 101*a* and a second casing 101*b*. The first casing 101*a* is equipped with various devices, various components, etc., including an image forming unit 700 that realizes the process from feeding recording material S to transferring a toner image. On the other hand, the second casing 101*b* is equipped with various devices, various members, etc., such as a fixing unit 800 that realizes the process of fixing the toner image by feeding the recording material S while heating the recording material S. The second casing 101*b* has an operation portion 200 with a display portion capable of displaying various information and keys capable of inputting various information in response to user operation on the front side. The second casing 101*b* is located at one end (downstream) of the first casing 101*a* in the width direction of the image forming apparatus 100, and the first casing 101*a* and the second casing 101*b* are connected to each other so that recording material S can be passed between each other.

An electrical unit (not shown) with a power supply board may be located on the rear side of these first and second casings 101*a* and 101*b*. In this document, the side where the user stands when operating the control portion 200 to operate the image forming apparatus 100 is referred to as the "front" side, and the opposite side is referred to as the "rear" side. The side surface on the left when looking at the image forming apparatus 100 from the front is referred to as the "left side surface," and the side surface on the right when looking at the front is referred to as the "right side surface."

The image forming apparatus 100 is equipped with four image forming portions Pa, Pb, Pc, and Pd that form yellow, magenta, cyan, and black images, respectively. In this example, the image forming portion Pa is an example of the first image forming unit located at one endmost side in the arrangement direction of the plurality of image forming units. The image forming portion Pd, which is located at the other end in the arrangement direction of the image forming unit, is an example of a second image forming unit. The image forming portion Pb is an example of a third image forming unit, and the image forming portion Pc is an example of a fourth image forming unit. The image forming apparatus 100 forms a toner image on the recording material S in response to an image signal received from a document reader 190 that reads an image signal from the document or an external device (not shown) such as a personal computer. The image forming apparatus 100 of the present embodiment is a large commercial printing device in which each of the multiple image forming portions mounted in parallel on the first casing 101*a* is large, as compared to an office or home use apparatus.

In the case of the present embodiment, the image forming portions Pa to Pd, primary transfer rollers 24*a* to 24*d*, intermediate transfer belt 130, multiple rollers 13 to 15, and secondary transfer outer roller 11 configure an image forming unit 700 which forms a toner image on the recording material S. The recording material S may be plain paper, thick paper, rough paper, uneven paper, coated paper, and other paper, plastic film, and cloth.

As shown in FIG. 1, the image forming portions Pa to Pd are arranged side by side along the moving direction of an intermediate transfer belt 130. The intermediate transfer belt 130 is stretched over a plurality of rollers (13, 14, 15) and moved in the direction of arrow R2. The intermediate transfer belt 130 bears and feeds the toner image to be primary transferred as described below. A secondary transfer outer roller 11 is positioned opposite a secondary transfer inner roller 14 that stretches the intermediate transfer belt 130 and the intermediate transfer belt 130, forming a secondary transfer section T2 that transfers the toner image on the intermediate transfer belt 130 to the recording material S. A fixing unit 800 is located downstream of the secondary transfer portion T2 in the recording material feeding direction.

On the lower side of the image forming apparatus 100, a plurality (in this case, two) of cassettes 10 in which recording material S is stored are arranged. These cassettes 10 contain recording materials S of different sizes and thicknesses, and the recording material S is selectively fed from one of the cassettes 10. The recording material S is fed from the cassette 10 to the registration roller 12 through the feeding path by the feeding roller 16. The registration roller 12 then rotates in synchronization with the toner image formed on the intermediate transfer belt 130, and the recording material S is fed toward the secondary transfer section T2. Not only the recording material S stored in the cassette 10, but also the recording material S placed on the manual feeding section (not shown) may be fed.

The image forming portions Pa, Pb, Pc, and Pd have substantially the same configuration except that the toner images are developed in different colors. Therefore, the yellow image forming portion Pa is described here as a representative image forming portion, and the other image forming portions Pb, Pc, and Pd are omitted from the description.

A cylindrical photosensitive drum 3*a* is provided in the image forming portion Pa. The photosensitive drum 3*a* is rotatably driven by a motor (not shown). Around the photosensitive drum 3*a* are arranged a charging device 2*a*, an exposure device 1*a*, a developing device 1*a*, a primary transfer roller 24*a*, and a drum cleaning device 4*a* as a charging unit.

The process of forming a full-color image, for example, using an image forming apparatus 100 is described below. First, when an image forming operation is started, the surface of a rotating photosensitive drum 3*a* is uniformly charged by a charging device 2*a*. The charging device 2*a* is, for example, a corona charger that charges the surface of the photosensitive drum 3*a* to a uniform potential by irradiating charged particles associated with a corona discharge. The photosensitive drum 3*a* is then scanned and exposed by a laser beam corresponding to an image signal emitted from the exposure device 1*a*. As a result, an electrostatic latent image is formed on the surface of the photosensitive drum 3*a* in response to the image signal. The electrostatic latent image formed on the photosensitive drum 3*a* is developed into a visible toner image by a developer containing toner and carrier contained in the developing device 1*a*. In other words, the photosensitive drum 3*a* is supplied with toner by the developing device 1*a* to develop the toner image. The developer is circulated and fed by a feeding screw (not shown) in the developing devices 1*a* to 1*d*.

The toner image formed on the photosensitive drum 3*a* is primary transferred to the intermediate transfer belt 130 at the primary transfer portion T1, which is composed of the primary transfer roller 24*a* positioned across the intermediate transfer belt 130. In this case, a primary transfer voltage is applied to the primary transfer roller 24*a*. Toner remaining on the surface of the photosensitive drum 3*a* after primary transfer is removed by the drum cleaning device 4*a*.

Such operations are performed sequentially in each of the yellow, magenta, cyan, and black image forming portions Pa to Pd, and the toner images of the four colors are superimposed on the intermediate transfer belt 130. Thereafter, the recording material S stored in cassette 10 is transported to the secondary transfer section T2 in accordance with the timing of toner image formation. Then, by applying a secondary transfer voltage to the secondary transfer outer roller 11, the full-color toner image formed on the intermediate transfer belt 130 is secondary transferred to the recording material S in a batch. The toner remaining on the intermediate transfer belt 130 after the secondary transfer is removed by a belt cleaning device (not shown).

In the present embodiment, photosensitive drums 3*a* and 3*b* correspond to a first photosensitive member, and photosensitive drums 3*c* and 3*d* correspond to a second photosensitive member. In addition, developing units 1*a* and 1*b* correspond to the first developing unit, and developing units 1*c* and 1*d* correspond to the second developing unit. Furthermore, charging devices 2*a* and 2*b* correspond to the first charging unit, and charging devices 2*c* and 2*d* correspond to the second charging unit.

The recording material S on which the toner image has been transferred is fed to a fixing unit 800. The fixing unit 800 fixes the toner image on the recording material S by applying heat and pressure to the recording material S on which the toner image is transferred. In the case of the present embodiment, after applying heat and pressure to the recording material S by the first fixing device 81, heat and pressure can be selectively applied by the second fixing device 91. The fixing unit 800 can switch by means of a fixing switch flapper 95 whether the recording material S is to be fed toward the second fixing device 91 after passing through the first fixing device 81 or whether it is to be fed bypassing the second fixing device 91 after passing through the first fixing device 81.

The second fixing device 91 is positioned downstream of the feeding direction of the recording material S from the first fixing device 81. The second fixing device 91 is selectively used to add gloss to the toner image on the recording material S fixed by the first fixing device 81. For example, when the recording material S is a coated paper such as glossy paper or synthetic paper, the recording material S is fed along a fixing route 30*a* so that fixing is performed at both the first fixing device 81 and the second fixing device 91. In contrast, when the recording material S is an uncoated paper such as plain paper, the recording material S that has passed through the first fixing device 81 is fed along a fixing bypass route 30*b* so that fixing is performed at the first fixing device 81 but not at the second fixing device 91.

Since the first fixing device 81 and the second fixing device 91 described above may have the same configuration, the first fixing device 81 is used here as an example. The first fixing device 81 has a fixing roller 82 (or fixing belt) that can rotate in contact with the toner image-fixed surface of the recording material S, and a pressure belt 83 (or pressure roller) that contacts the fixing roller 82 to form a fixing nip portion. At least one of the fixing roller 82 and the pressure belt 83 is heated by a heater (not shown). The first fixing device 81 applies heat and pressure to the recording material S in the fixing nip portion formed by the fixing roller 82 and the pressure belt 83 to fix the toner image to the recording material S when the recording material S with the toner image formed is nipped and fed.

In the case of the present embodiment, the image forming apparatus 100 is capable of double-side printing. In the case of single-sided printing, a recording material S with a fixed toner image is fed to a discharging feed path 150 and discharged to the outside of the image forming apparatus 100. In the case of double-side printing, the recording material S with a fixed toner image is fed to the double-sided reversing feed path 600. The double-sided reversing feed path 600 is formed over a first casing 101*a* and a second casing 101*b*. In the double-sided reversing feed path 600, the recording material S is reversed by a switchback operation, and the front and back surfaces of the recording material S are switched. The reversed recording material S is fed toward a registration roller 12, and is fed to a secondary transfer portion T2 with the unprinted back side facing the intermediate transfer belt 130 side by the registration roller 12. In the secondary transfer portion T2, the full-color toner image formed on the intermediate transfer belt 130 is transferred to the recording material S (back side) in a batch. Thereafter, the recording material S is discharged to the outside of the image forming apparatus 100 with the immediately preceding image formed side (image forming side) facing up after the toner image is fixed by the fixing unit 800. The above-mentioned discharging feed path 150 and the double-sided reversing feed path 600 are switched by the feed switching flapper 160. In the present embodiment, the fixing unit 800 is configured with two fixing devices, but it may be configured with only one fixing device. The second casing 101*b* may also be equipped with a cooling device that cools the recording material S after the toner image has been fixed by the fixing unit 800.

A finisher device 300 is connected to the image forming apparatus 100 so that the recording material S can be delivered, and the recording material S discharged from the image forming apparatus 100 is transferred to the finisher device 300. The recording material S transported to the finisher device 300 is processed by the finisher device 300 through post-processing such as punching to pierce holes in the recording material S or staple processing to bind multiple sheets of recording material S and bind them together with a needle. In the finisher device 300, the punched recording materials S are discharged separately to the upper discharge tray 301 and the bundle of stapled recording materials S to the lower discharge tray 302.

Figure 2:
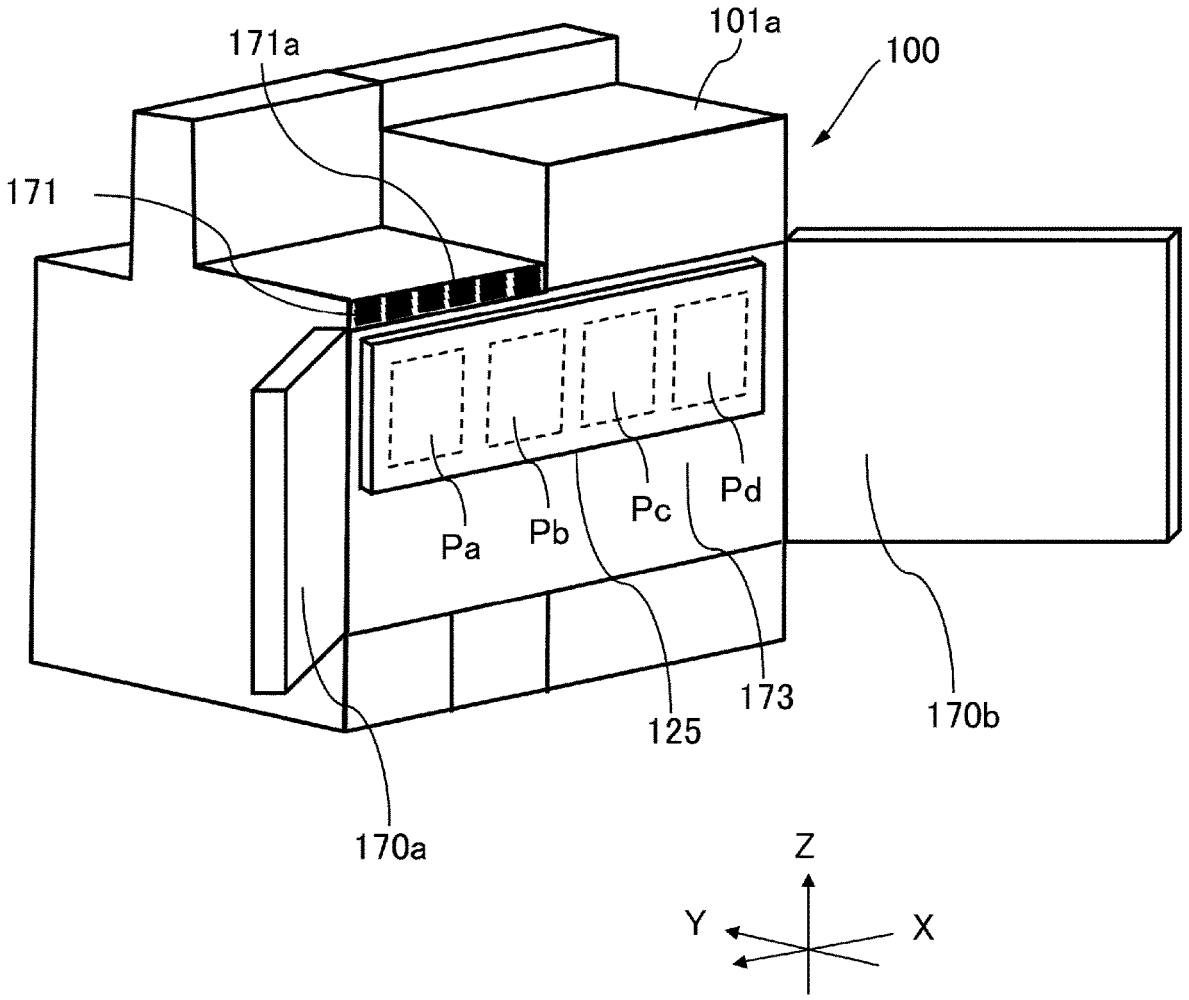
FIG. 2 is a left-side perspective view showing the front door of the image forming apparatus open.

The airflow configuration in the image forming apparatus 100 is described below using FIGS. 2 through 8 with reference to FIG. 1. FIG. 2 is a left-side perspective view of the image forming apparatus 100 with the front door open. Part (a) of FIG. 3 is a left-side perspective view of the image forming apparatus 100 with the front door closed, and part (b) of FIG. 3 is a right-side perspective view of the image forming apparatus 100 with the front door closed. FIG. 4 is a schematic diagram showing the arrangement of the left side suction unit and the right-side suction unit in the first casing.

As shown in FIG. 2, the front of the first casing 101*a* has a left front door 170*a* and a right front door 170*b* as opening and closing covers, which can be opened and closed in a circular motion with an approximate center as shown in the Figure. The front surface of the first casing 101*a* has an inner cover 173 on the inside of the left front door 170*a* and the right front door 170*b*. The inner cover 173 is designed to prevent the user from accidentally touching the moving parts and electrical wiring in the first casing 101*a* when the front doors (170*a*, 170*b*) are opened. However, the inner cover 173 is removable from the first casing 101*a* by means of a screw or other means so that service personnel can perform maintenance work. The inner cover 173 has openings that allow the image forming portions Pa to Pd (illustrated by dotted lines) to be inserted and removed separately from the first casing 101*a*, so that the inner cover unit 125 is removably provided on the inner cover 173 so as to cover the image forming portions Pa to Pd.

In the case of the present embodiment, the image forming portions Pa and Pb are supported by the first casing 101*a* in the position opposite the left front door 170*a* in the closed state, and the image forming portions Pc and Pd are supported by the first casing 101*a* in a position opposite the right front door 170*b* in the closed state. In other words, image forming portions Pa, Pb are positioned to the left of the center when viewed from the front, and image forming portions Pc, Pd are positioned to the right of the center when viewed from the front.

As shown in FIG. 2 and part (a) of FIG. 3, a suction cover 171 is provided above the left front door 170*a*, and the suction cover 171 has a suction port 171*a* as a first suction port provided closer to the image forming portion Pa than the image forming portion Pd in the arrangement direction of a plurality of image forming portions Pa to Pd. In other words, the suction port 171*a* is formed on the suction cover 171 as an exterior cover, facing the front of the image forming apparatus 100. On the left side surface side of the first casing 101*a*, a left side suction unit 124 which has a fan that sucks in outside air from the suction port 171*a* is arranged. The outside air sucked from the suction port 171*a* is guided through the left side suction unit 124 and the inner cover unit 125 to the developing devices 1*a* and 1*b*. In the case of the present embodiment, another casing, a second casing 101*b*, is connected to the left side surface of the first casing 101*a*, which is downstream of the feeding direction of the recording material S (see FIG. 1). Therefore, the suction port 171*a* is not formed on the left side surface (first side surface) of the first casing 101*a* facing the second casing 101*b*, but is formed on the front surface (second side surface) that intersects the left side surface (first side surface) of the first casing 101*a*.

As shown in part (b) of FIG. 3, a right cover 172 is provided on the right-side surface of the first casing 101*a*. The right cover 172 has a suction port 172*a* as a second suction port provided closer to the image forming portion Pd than the image forming portion Pa in the arrangement direction of the plurality of image forming portions Pa to Pd. In other words, the suction port 172*a* is formed on the right cover 172, facing the right side of the image forming apparatus 100. Then, on the right-side surface side of the first casing 101*a*, a right-side suction unit 126 with a fan that sucks in outside air from the suction port 172*a* is located. The outside air sucked from the suction port 172*a* is guided to the developing devices 1*c* and 1*d* passing through the right-side suction unit 126 and the inner cover unit 125. In the case of the present embodiment, another casing is not connected to the right-side surface side of the first casing 101*a*, which is the other end side of the image forming apparatus 100 (here, upstream of the feeding direction of the recording material S). Therefore, the suction port 172*a* is formed on the right-side surface (third side surface) of the upstream side opposite the left side surface (first side surface) of the first casing 101*a* in the feeding direction of the recording material S. In the present embodiment, the left side suction unit 124 is an example of a first body duct unit and the right-side suction unit 126 is an example of a second body duct unit.

In the case of the present embodiment, the first fixing device 81 and the second fixing device 91 supported by the second casing 101*b* generate heat, which is cooled by air cooling by a cooling mechanism omitted in the figure. The second casing 101*b* is thereby exhausted through an unshown exhaust port on the rear side. It is preferable for the outside air to be sucked in from the suction port 171*a* and the suction port 172*a* to have a lower temperature. Therefore, the suction port 171*a* and suction port 172*a* are formed not on the rear side of the second casing 101*b*, where the temperature tends to be higher, but as far away from it as possible, closer to the front side of the first casing 101*a* and the front side surface.

As shown in FIG. 4, the support frame that supports each unit, etc. in the first casing 101*a* has four support columns at the four corners: front support columns 185*a* and 185*b* on the front side and rear support columns 185*c* and 185*d* on the rear side. The support frame also has side panels, etc. (not shown), which support the internal units of the image forming apparatus 100 described above. These front support columns 185*a*, 185*b* and rear support columns 185*c*, 185*d* are connected to a bottom plate 185 and are erected upward from the bottom plate 185. The left side suction unit 124 is supported over front support column 185*a* and rear support column 185*c*, and the right-side suction unit 126 is supported over front support column 185*b* and rear support column 185*d*. In the present embodiment, support column 185*a* is an example of a first support column and support column 185*c* is an example of a second support column. In the present embodiment, support column 185*b* is an example of a third support column, and support column 185*d* is an example of a fourth support column. The left side suction unit 124 and the right-side suction unit 126 are supported so that the outlets 174*a*, 174*b*, 179*b*, 179*a* of the outside air sucked in by the developing suction fans 180*a*, 180*b*, 180*c*, 180*d*, respectively, face forward.

The left side suction unit 124 is supported by the front support column 185*a* and the rear support column 185*c* so that the developing suction fans 180*a* and 180*b* as the first fans are positioned at the downstream end of the first casing 101*a* in the feeding direction of the recording material S. On the other hand, the right-side suction unit 126 is supported by the front support column 185*b* and the rear support column 185*d* so that the developing suction fans 180*c* and 180*d* as the second fan are located at the upstream end of the first casing 101*a* in the feeding direction of recording material S. The developing suction fan 180*b* is a first fan provided at one end side than the image forming portion Pa in the arrangement direction of the plurality of image forming portions Pa to Pd, and is an example of a first fan provided closer to the image forming portion Pa than the image forming portion Pd. The developing suction fan 180*c* is a second fan provided on the other end side than the image forming portion Pd in the arrangement direction of the plurality of image forming portions Pa to Pd, and is an example of a second fan provided closer to the image forming portion Pd than the image forming portion Pa. The developing suction fan 180*a* is a third fan provided on one end side than the image forming portion Pa in the arrangement direction of the plurality of image forming portions Pa to Pd, and is an example of a third fan provided closer to the image forming portion Pa than the image forming portion Pd. The developing suction fan 180*d* is a fourth fan provided on the other end side than the image forming portion Pd in the arrangement direction of the plurality of image forming portions Pa to Pd, and is an example of a fourth fan provided closer to the image forming portion Pd than the image forming portion Pa.

Furthermore, the left suction unit 124 and the right suction unit 126 are supported so that the developing suction fans 180*a* and 180*b* of the left suction unit 124 and the developing suction fans 180*c* and 180*d* of the right suction unit 126 are located rearward of the two front supporting columns 185*a* and 185*b* on the front side, respectively. In this way, the user can operate the image forming apparatus 100 without worrying about the fan operation noise because the operation noise of the developing suction fans 180*a* to 180*d* is blocked by the front doors (170*a*, 170*b*, see part (a) of FIG. 3). In other words, the noise caused by the fan operation noise can be suppressed.

<Suction Unit>

The left side suction unit 124 as the first suction unit and the right-side suction unit 126 as the second suction unit are explained using FIG. 5 through part (b) of FIG. 8 with reference to FIG. 1. As shown in FIG. 5, the left side suction unit 124 has a left side main body duct 174, developing suction fans 180*a* and 180*b*, and a side surface duct 1741. The developing suction fans 180*a* and 180*b* are sirocco fans for cooling the developing devices 1*a* and 1*b* supported by the first casing 101*a*. The left side main body duct 174 is a duct with a space formed inside that is connected to the suction port 171*a* formed on the front side of the image forming apparatus 100.

The developing suction fans 180*a*, 180*b* and the side surface duct 1741 are located on the left side surface of the left side main body duct 174. In other words, a connection port is formed on the left side surface of the left side main body duct 174, which is connected to the developing suction fans 180*a* and 180*b*, and the outside air sucked in from the suction port 171*a* according to the operation of the developing suction fans 180*a* and 180*b* passes through the interior of the left side main body duct 174. The side surface duct 1741 has developing ducts 181*a* and 181*b* formed inside. The side surface duct 1741 is connected to the developing suction fans 180*a* and 180*b* so that the outside air that passed through the developing suction fans 180*a* and 180*b* passes through the developing ducts 181*a* and 181*b*, respectively.

As shown in part (a) of FIG. 8, the outside air sucked from the suction port 171*a* is sent to the developing devices 1*a* and 1*b* via the left side main body duct 174, developing suction fans 180*a* and 180*b*, developing ducts 181*a* and 181*b*, and inner cover unit 125. It is preferable to place a filter (not shown) in the flow path from the suction port 171*a* to the left side main body duct 174 in order to remove dust and other particles from the outside air sucked in from the suction port 171*a*.

Next, the right-side suction unit 126 is explained using FIG. 6. As shown in FIG. 6, the right-side suction unit 126 has a right-side main body duct 176, developing suction fans 180*c* and 180*d*, and a passage duct 179. The developing suction fans 180*c* and 180*d* are sirocco fans for blowing outside air to the developing devices 1*c* and 1*d* supported by the first casing 101*a*. The right-side main body duct 176 is a duct with a space formed inside that is connected to the suction port 172*a* formed on the right-side surface of the image forming apparatus 100.

The developing suction fans 180*c* and 180*d* are provided on the right-side surface of the right-side main body duct 176. That is, the right-side main body duct 176 has a connecting port that is connected to the developing suction fans 180*c* and 180*d*, and the outside air sucked from the suction port 172*a* passes through the inside of the right-side main body duct 176 in response to the operation of the developing suction fans 180*c* and 180*d*. Then, the passage duct 179 has developing suction ducts 181*c* and 181*d* formed inside. The passage duct 179 is connected to the developing suction fans 180*c* and 180*d* so that the outside air passing through the developing suction fans 180*c* and 180*d* passes through the developing ducts 181*c* and 181*d*, respectively.

As shown in part (a) of FIG. 8, the outside air sucked in from the suction port 172*a* is sent to the developing devices 1*c* and 1*d* via the right-side main body duct 176, developing suction fans 180*c* and 180*d*, developing ducts 181*c* and 181*d*, and inner cover unit 125. It is preferable to place a filter (not shown) in the flow path from the suction port 172*a* to the right-side main body duct 176 in order to remove dust and other particles from the outside air sucked from the suction port 172*a*.

Thus, in the present embodiment, the left side suction unit 124 and the right-side suction unit 126 are used to blow outside air to the developing devices 1*a*-1*d*. In order to blow outside air to the developing devices 1*a* and 1*b*, which are located to the left of the center when viewed from the front, a left side suction unit 124 with developing suction fans 180*a* and 180*b* is located on the left side surface of the first casing 101*a* of the image forming apparatus 100, which is closer to the developing devices 1*a* and 1*b*. In addition, a suction port 171*a* is formed on the front side of the image forming apparatus 100 closer to the left side suction unit 124 than the center of the apparatus 100 for the suction of outside air by the developing suction fans 180*a* and 180*b*. That is, the suction port 171*a* is formed downstream from the center of the first casing 101*a*, which is closer to the developing suction fans 180*a* and 180*b* than the developing suction fans 180*c* and 180*d* in the feeding direction of the recording material S. The second casing 101*b* is connected to the left side surface side of the first casing 101*a*. As in the present embodiment, by placing the suction port 171*a* on the front side surface of the first casing 101*a*, it is possible to prevent the intake air from the suction port 171*a* from being blocked by the second casing 101*b*.

On the other hand, a right-side suction unit 126 with developing suction fans 180*c* and 180*d* is located on the right-side surface of the first casing 101*a* of the image forming apparatus 100 near the developing devices 1*c* and 1*d* in order to blow outside air to the developing devices 1*c* and 1*d*, which are located on the right side from the front. And for the suction of outside air by the developing suction fans 180*c* and 180*d*, a suction port 172*a* is formed on the right side surface of the image forming apparatus 100 near the right side suction unit 126. That is, the suction port 172*a* is formed at one end of the image forming apparatus 100 in the width direction from the center of the first casing 101*a*. Here, the suction port 172*a* is formed upstream from the center of the first casing 101*a*, which is closer to the developing suction fans 180*c* and 180*d* than the developing suction fans 180*a* and 180*b* in the feeding direction of the recording material S.

<Inner Cover Unit>

FIG. 7 shows the inner cover unit 125 used in the present embodiment and is a schematic view of the inner surface of the inner cover unit 125. In the present embodiment, as shown in FIG. 7, flexible tubes 183*a* and 183*b* as first relay ducts and flexible tubes 183*c* and 183*d* as second relay ducts are arranged on the inner surface of the inner cover unit 125 as relay ducts for passing outside air to cool the developing devices 1*a* to 1*d*. These flexible tubes 183*a*-183*d* are attached to the inner surface of the inner cover unit 125 using wire saddles, for example.

The flexible tubes 183*a*-183*d* are made of resin or metal such as PA6 (polyamide), for example, and formed into a cylindrical shape with a hollow interior, and are bellows-shaped tubular members with many convex portions continuously formed at predetermined intervals on the outer circumference, and are curvable. When these flexible tubes 183*a*-183*d* are curved, they are restricted from bending by the convex portions on the inside (compressed side) of the curvature, making them difficult to bend. Therefore, even if the flexible tubes 183*a*-183*d* are curved, the cross-sectional area remains the same compared to before the curvature, and the airflow per unit time can be guided without changing the airflow volume.

In this way, the outside air sucked in from the suction port 171*a* as a result of the operation of the developing suction fans 180*a* and 180*b* flows through the left side main body duct 174, the developing ducts 181*a* and 181*b*, and the flexible tubes 183*a* and 183*b* toward the developing devices 1*a* and 1*b*. On the other hand, the outside air sucked from the suction port 172*a* due to the operation of the developing suction fans 180*c* and 180*d* flows through the right-side main body duct 176, the developing ducts 181*c* and 181*d*, and the flexible tubes 183*c* and 183*d* to the developing devices 1*c* and 1*d*. In the present embodiment, the developing duct 181*b* and flexible tube 183*b* are examples of first ducts, and the developing duct 181*c* and flexible tube 183*d* are examples of second ducts. The developing duct 181*a* and flexible tube 183*a* are examples of a third duct, and the developing duct 181*d* and flexible tube 183*c* are examples of a fourth duct.

In the present embodiment, flexible tubes 183*a*-183*d* can be curved and stretched as desired on the inner surface side of the inner cover unit 125. In other words, the use of flexible tubes 183*a*-183*d* increases the degree of freedom in duct placement within a limited space. The arrangement of flexible tubes 183*a*-183*d* shown here is an example and is not limited to this.

The flexible tubes 183*a*-183*d* described above are formed in a rectangular shape with a cross-sectional area of "25 mm×20 mm" and a maximum length of "550 mm," for example. When the airflow volume of the developing suction fans 180*a*-180*d* is "0.5 $m^3$/min," the pressure loss of the flexible tubes 183*a*-183*d* is "approx. 99 Pa." If a developing suction fan 180*d* is installed in the left side suction unit 124 to send outside air to the developing device 1*d* using a flexible tube, the length of the flexible tube is "1100 mm" and the pressure loss of the flexible tube is "approx. 200 Pa." In other words, if a developing suction fan 180*d* is installed in the left side suction unit 124 to supply outside air to the developing device 1*d*, the pressure loss will be twice that of the present embodiment, and the developing suction fan 180*d* will require a fan with a larger power output. However, such a fan would be large and costly, making it difficult to apply.

Part (b) of FIG. 8 shows a comparative example where the developing suction fans 180*a*, 180*b* and developing suction fans 180*c*, 180*db* are placed in front of the front support columns 185*a*, 185*b* on the front side of the image forming apparatus 100.

In the comparative example shown in part (b) of FIG. 8, the developing suction fans 180*a*-180*d* are located in front of the front support columns 185*a* and 185*b*. The outside air sucked from suction ports 171*a* and 172*a* reaches the developing suction fans 180*a* to 180*d* via the left side main body duct 174 and the right-side main body duct 176. In the comparative example, outside air can be sent to the developing devices 1*a*-1*d* without going through the side surface duct 1741, the passage duct 179 (see FIGS. 5 and 6) and the inner cover unit 125 (see FIG. 2) in the present embodiment described above. In other words, the side surface duct 1741, the passage duct 179, and the inner cover unit 125 are not required in the comparative example.

However, the distance between the front support columns 185*a* and 185*b* and the left front door 170*a* and the right front door 170*b* is larger than in the present embodiment (part (a) of FIG. 8), as shown by arrows A and B. In other words, in the comparative example, the exclusive area in front of the support frame increases as space is secured for a fan, and the apparatus becomes larger in the front-back direction (arrow Y direction). More specifically, the exclusive area increases in front of the feeding path provided inside the support frame of the image forming apparatus 100. This causes the front cover of the first casing 101*a* to protrude more than the front covers of these second casing 101*b* and post-processing devices when the feeding paths are aligned and connected to the second casing 101*b* and post-processing devices (e.g., finisher device 300) that are connected downstream of the feeding direction, which reduces the appearance quality. In the comparative example shown in part (b) of FIG. 8, the inner cover 173 (see FIG. 2) is not provided. However, it is common practice to provide an inner cover 173 to prevent users from accidentally touching moving parts or electrical wiring in the casing. If an inner cover 173 is provided in the comparative case, the more exclusive area is correspondingly increased. In contrast, as described in part (a) of FIG. 8, the present embodiment prevents an increase in the exclusive area due to the fan arrangement. In other words, the image forming apparatus 100 is prevented from becoming larger in the front-back direction.

As described above, in the present embodiment, the left side suction unit 124 is located on the left side surface of the image forming apparatus 100 near the developing devices 1*a* and 1*b* in order to blow outside air to the developing devices 1*a* and 1*b*, which are located on the left side rather than the center when viewed from the front. For suction of outside air by the left side suction unit 124, a suction port 171*a* is formed in front of the left side of the image forming apparatus 100, closer to the left side suction unit 124 than to the center of the image forming apparatus 100. On the other hand, the right-side suction unit 126 is located on the right-side surface of the image forming apparatus 100 near the developing devices 1*c* and 1*d* in order to blow air to the developing devices 1*c* and 1*d*, which are located on the right side from the front rather than the center. For suction of outside air by the right side suction unit 126, a suction port 172*a* is formed on the right side surface of the image forming apparatus 100 close to the right side suction unit 126. Thus, the suction ports for suction of outside air to be blown to the plurality of developing devices 1*a* to 1*d* are divided into suction port 171*a*, which is formed on the side closer to the left side suction unit 124, and suction port 172*a*, which is formed on the side closer to the right side suction unit 126. In this way, the outside air sucked in by the left side suction unit 124 and the right-side suction unit 126 is guided through the ducts to the multiple developing devices 1*a* to 1*d* with sufficient airflow.

Second Embodiment

Next, as a second embodiment, the airflow configuration in the charging devices 2*a*-2*d* will be described. In FIG. 9, the charging device 2*a* is used as a representative example. As shown in FIG. 9, the charging device 2*a* electrically charges the surface of photosensitive drum 3*a* by ionizing the air around the charging wire 203*a* with a corona discharge to generate ions. The charging device 2*a* generates not only ions but also ozone during corona discharge. However, ozone must be collected because it tends to corrode, for example, the stainless steel grid (not shown) of the charging device 2*a*. Therefore, in order to send ozone to the ozone recovery filter 219*a* for recovery by outside air, a primary suction duct 202*a* that blows outside air to the charging device 2*a* and a primary exhaust duct 204*a* that exhausts air to the outside of the image forming apparatus 100 through the ozone recovery filter 219*a* are located in the vicinity of the charging device 2*a*.

The airflow configuration for sending outside air to the charging devices 2*a*-2*d* may be the same as the airflow configuration for sending outside air to the developing devices 1*a*-1*d* described above. Therefore, "developing" should be read as "charging" in the description of the airflow configuration for sending outside air to the developing devices 1*a*-1*d* described above. In other words, the outside air sucked in from suction port 171*a* as a result of the operation of the charging suction fans 180*a* and 180*b* flows through the left side main body duct 174, the charging ducts 181*a* and 181*b*, and the flexible tubes 183*a* and 183*b* toward the charging devices 2*a* and 2*b*. On the other hand, the outside air sucked from the suction port 172*a* due to the operation of the charging suction fans 180*c* and 180*d* flows through the right-side main body duct 176, the charging ducts 181*c* and 181*d*, and the flexible tubes 183*c* and 183*d* toward the charging devices 2*c* and 2*d*. In the present embodiment, the charging duct 181*b* and flexible tube 183*b* are examples of a first duct, and the charging duct 181*c* and flexible tube 183*d* are examples of a second duct. The charging duct 181*a* and flexible tube 183*a* are examples of a third duct, and the charging duct 181*d* and flexible tube 183*c* are examples of a fourth duct. The charging suction fan 180*b* is a first fan provided at one end side than the image forming portion Pa in the arrangement direction of the plurality of image forming portions Pa to Pd, and is an example of a first fan provided closer to the image forming portion Pa than the image forming portion Pd. The charging suction fan 180*c* is a second fan provided on the other end side than the image forming portion Pd in the arrangement direction of the plurality of image forming portions Pa to Pd, and is an example of a second fan provided closer to the image forming portion Pd than the image forming portion Pa. The charging suction fan 180*a* is a third fan provided on one end side than the image forming portion Pa in the arrangement direction of the plurality of image forming portions Pa to Pd, and is an example of a third fan provided closer to the image forming portion Pa than the image forming portion Pd. The charging suction fan 180*d* is a fourth fan provided on the other end side than the image forming portion Pd in the arrangement direction of the plurality of image forming portions Pa to Pd, and is an example of a fourth fan provided closer to the image forming portion Pd than the image forming portion Pa.

However, as shown in FIG. 1 and FIG. 9, the charging devices 2*a*-2*d* are located above the developing devices 1*a*-1*d*, so the flexible tubes 183*a*-183*d* in the inner cover unit 125 are arranged differently. FIG. 10 is a schematic view showing the inner surface side of the inner cover unit 125 for air intake to the charging devices 2*a*-2*d*.

As shown in FIG. 10, flexible tubes 183*a*-183*d* are arranged on the inner surface side of the inner cover unit 125 as relay ducts for passing outside air to be blown to the charging devices 2*a*-2*d*. The flexible tubes 183*a*-183*d* are attached to the inner surface of the inner cover unit 125 using, for example, wire saddles. The arrangement of the flexible tubes 183*a*-183*d* shown here is an example and is not limited to this.

The flexible tubes 183*a*-183*d*, which pass outside air to be blown to the charging devices 2*a*-2*d*, are rectangular in shape with a cross-sectional area of "25 mm×20 mm" and a maximum length of "500 mm," for example. And when the airflow volume of the charging suction fans 180*a*-180*d* is "1.0 $m^3$/min," the pressure loss of the flexible tubes 183*a*-183*d* is "approx. 309 Pa." If a charging suction fan 180*d* is installed in the left side suction unit 124 and a flexible tube is used to supply outside air to the charging device 2*d*, the length of the flexible tube is "1000 mm" and the pressure loss of the flexible tube is "approx. 618 Pa." In other words, if a charging suction fan 180*d* is installed in the left side suction unit 124 to send outside air to the charging device 2*d*, the pressure drop will be twice that of the present embodiment, and the charging suction fan 180*d* will require a fan with a higher output. However, such fans are difficult to employ because of their large size and high cost.

Thus, the airflow configuration of the first embodiment described above can also be adopted for the airflow configuration that sends outside air sucked by the suction fan to the charging devices 2*a* to 2*d*. Therefore, for an image forming apparatus where multiple units mounted in parallel in a casing are large, the printing speed is fast, and a large amount of airflow to multiple units is required, the same effect as in the first embodiment can be achieved by a simple configuration to guide the outside air sucked in by suction fans to multiple units via ducts with a sufficient amount of airflow.

In the first embodiment, the airflow configuration for suction to the developer devices 1*a*-1*d* is shown, and in the second embodiment, the airflow configuration for suction to the charging devices 2*a*-2*d* is shown, but both of these may be provided. In addition, the configuration of airflow to each device may be formed entirely by ducts instead of flexible tubes.

Other Embodiments

In the embodiment described above, an example is shown in which a second casing 101*b*, which is another casing, is connected to the left-side surface side of the first casing 101*a*, which is downstream of the feeding direction of the recording material S (see FIG. 1). However, this is not limited to this. For example, a second casing 101*b*, which is another casing, may be connected to the right-side surface side of the first casing 101*a*, which is the upstream side of the feeding direction of the recording material S. In such a case, the suction port 107*a* and the suction port 171*b* are formed at the positions shown in FIG. 11. That is, as shown in FIG. 11, the suction port 171*a* is formed on the left side surface of the image forming apparatus 100. On the other hand, the suction port 172*a* is formed on the front side of the image forming apparatus 100, to the right of the center of the image forming apparatus 100.

FIG. 12 shows a suction unit when the suction port 171*a* and the suction port 172*a* are formed at the locations shown in FIG. 11 above. As shown in FIG. 12, compared to the case in which the suction port 171*a* is formed on the front surface of the image forming apparatus 100 and the suction port 172*a* is formed on the right-side surface of the image forming apparatus 100 (see FIG. 4), the left side suction unit 124 and the right-side suction unit 126 are interchanged on the left and right sides. However, as shown in FIG. 12, in a suction unit 212 located to the left of the center of the image forming apparatus 100, developing suction fans 212*a* and 212*b* and passage duct 213 are provided on the left side surface of the main body duct 210. On the other hand, in the suction unit 211 located on the right side of the image forming apparatus 100 rather than the center, developing suction fans 215*a* and 215*b* and passage duct 215 are provided on the right-side surface of the main body duct 214.

Since the air flow of the suction unit 212 is the same as that of the right-side suction unit 126 described above, and the air flow of the suction unit 211 is the same as that of the left side suction unit 124 described above, the explanation is omitted here. Also, the air flow from these suction units 211 and 212 to the developing devices 1*a*-1*d* is the same as that of the left side suction unit 124 and right-side suction unit 126 described above, so the explanation is omitted here.

In the embodiments described above, the two suction ports are formed on the front and right-side surfaces of the image forming apparatus 100 (see parts (a) and (b) of FIG. 3) and on the front and left side surfaces of the image forming apparatus 100 (see FIG. 11), but this is not limited to this. For example, the two suction ports may both be formed on the front surface of the image forming apparatus 100. However, in this case, one suction port is formed on the left side of the center in the front of the image forming apparatus 100, and the other suction port is formed on the right side of the center in the front of the image forming apparatus 100. Alternatively, the two suction ports may both be formed on the left-side and right-side surfaces of the image forming apparatus 100.

In the embodiments described above, four image forming portions Pa, Pb, Pc, and Pd are arranged side by side along the direction of movement of the intermediate transfer belt 130, but the number of image forming portions is not limited to this and may be five or more, for example. In such a case, those image forming portions are divided into two parts based on the center of the image forming apparatus 100 as described above: the device that blows the outside air sucked by the left side suction unit 124 (suction unit 211) and the device that sends the outside air sucked by the right-side suction unit 126 (suction unit 212). Then, two suction ports are formed at each of the above-mentioned locations.

In the embodiments described above, the case in which a sirocco fan is used as a suction fan is described as an example, but this is not limited to this. An axial flow fan may also be used as a suction fan.

According to the present invention, it is possible to suppress insufficient airflow to each image forming portion with a simple configuration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-100082 filed on Jun. 16, 2021, which is hereby incorporated by reference herein in its entirety.

What is claimed is:

1. An image forming apparatus for forming an image on a recording material comprising:

a first image forming unit, one of a plurality of image forming units, positioned on a first endmost side in an arrangement direction of the plurality of image forming units and being closest to a first edge of the image forming apparatus among the plurality of image forming units, said first image forming unit including a first photosensitive member, a first charging unit configured to charge said first photosensitive member by corona discharge and a first developing unit configured to develop an electrostatic latent image formed on said first photosensitive member with toner;

a second image forming unit, one of the plurality of image forming units, positioned on a second endmost side in the arrangement direction and being closest to a second edge, opposite to the first edge, of the image forming apparatus among the plurality of image forming units, said second image forming unit including a second photosensitive member, a second charging unit configured to charge said second photosensitive member by corona discharge and a second developing unit configured to develop an electrostatic latent image formed on said second photosensitive member with toner;

a first fan provided closer to the first edge of the image forming apparatus in the arrangement direction than said first image forming unit is to the first edge, said first fan sucking outside air to supply from a first suction port to said first image forming unit, and the first suction port being positioned closer to said first image forming unit in the arrangement direction than to said second image forming unit; and a second fan provided closer to the second edge of the image forming apparatus in the arrangement direction than said second image forming unit is to the second edge, said second fan sucking outside air to supply from a second suction port to said second image forming unit, and the second suction port being positioned closer to said second image forming unit in the arrangement direction than to said first image forming unit;

wherein said first fan is positioned closer to said first image forming unit in the arrangement direction than to said second image forming unit, and wherein said second fan is positioned closer to said second image forming unit in the arrangement direction than to said first image forming unit.

2. An image forming apparatus according to claim 1, further comprising:

a first duct configured to guide the air sucked by said first fan to said first image forming unit; and a second duct configured to guide the air sucked by said second fan to said second image forming unit.

3. An image forming apparatus according to claim 2, wherein said first duct guides the air sucked by said first fan to said first charging unit; and wherein said second duct guides the air sucked by said second fan to said second charging unit.

4. An image forming apparatus according to claim 2, wherein said first duct guides the air sucked by said first fan to said first developing unit; and wherein said second duct guides the air sucked by said second fan to said second developing unit.

5. An image forming apparatus according to claim 2, further comprising a first casing including the plurality of image forming units, said first fan, said second fan, said first duct and said second duct; and a second casing adjacent to a downstream side of said first casing in a feeding direction of the recording material, wherein a first side surface of said first casing opposes said second casing, wherein said first suction port is formed on a second side surface crossing said first side surface, and wherein said second suction port is formed on a third side surface opposite to said first side surface in the arrangement direction.

6. An image forming apparatus according to claim 2, further comprising a first casing including the plurality of image forming units, said first fan, said second fan, said first duct and said second duct; and a second casing adjacent to a downstream side of said first casing in a feeding direction of the recording material, wherein a first side surface of said first casing opposes said second casing, wherein said second suction port is formed on a second side surface crossing said first side surface, and wherein said first suction port is formed on a third side surface opposite to said first side surface in the arrangement direction.

7. An image forming apparatus according to claim 5, wherein said second surface is a side surface of on a front side of said image forming apparatus.

8. An image forming apparatus according to claim 5, wherein said first casing further includes a transfer unit configured to transfer a toner image formed on said first photosensitive member and said second photosensitive member onto the recording material, and said second casing includes a fixing unit configured to heat the recording material on which the toner image is transferred and to fix the toner image.

9. An image forming apparatus according to claim 6, wherein said first casing further includes a transfer unit configured to transfer a toner image formed on said first photosensitive member and said second photosensitive member onto the recording material, and said second casing includes a fixing unit configured to heat the recording material on which the toner image is transferred and to fix the toner image.

10. An image forming apparatus according to claim 1, further comprising a support frame including a bottom plate and a plurality of support columns erected on said bottom plate;

a first body duct unit, to which said first fan is fixed, configured to guide the air sucked from said first suction port to said first fan; and a second body duct unit, to which said second fan is fixed, configured to guide the air sucked from said second suction port to said second fan;

wherein the plurality of support columns includes a first column provided on a front side of said image forming apparatus, a second column provided on a rear side of said image forming apparatus and configured to support said first body duct unit with said first column, a third column provided on the front side and different from said first column, and a fourth column provided on the rear side and configured to support said second body duct unit with said third column, wherein said first fan is positioned closer on the rear side than said first column, and wherein said second fan is positioned closer on the rear side than said third column.

11. An image forming apparatus according to claim 1, further comprising an opening and closing cover openably and closably provided on a front side of said image forming apparatus; and an inner cover unit provided opposite to an inner surface of said opening and closing cover in a state in which said opening and closing cover is closed, wherein said inner cover unit includes said first duct and said second duct.

12. An image forming apparatus according to claim 1, further comprising:

a third image forming unit positioned between said first image forming unit and said second image forming unit, said third image forming unit including a third photosensitive member, a third charging unit configured to charge said third photosensitive member by corona discharge and a third developing unit configured to develop an electrostatic latent image formed on said third photosensitive member with toner;

a fourth image forming unit positioned between said second image forming unit and said third image forming, said fourth image forming unit including a fourth photosensitive member, a fourth charging unit configured to charge said fourth photosensitive member by corona discharge and a fourth developing unit configured to develop an electrostatic latent image formed on said fourth photosensitive member with toner;

a third fan provided closer on the first endmost side in the arrangement direction than said first image forming unit, said third fan sucking outside air from said first suction port; and a fourth fan provided closer on the second endmost side in the arrangement direction than said second image forming unit, said fourth fan sucking outside air from said second suction port;

wherein said third fan is positioned closer to said first image forming unit in the arrangement direction than to said second image forming unit, and wherein said fourth fan is positioned closer to said second image forming unit in the arrangement direction than to said first image forming unit.

13. An image forming apparatus according to claim 12, further comprising:

a third duct configured to guide the air sucked by said third fan to said third image forming unit; and a fourth duct configured to guide the air sucked by said fourth fan to said fourth image forming unit.

14. An image forming apparatus according to claim 12, further comprising a support frame including a bottom plate and a plurality of support columns erected on said bottom plate;

a first body duct unit, to which said first fan and said third fac are fixed, configured to guide the air sucked from said first suction port to said first fan and said third fan; and a second body duct unit, to which said second fan and said fourth fan are fixed, configured to guide the air sucked from said second suction port to said second fan and said fourth fan;

wherein the plurality of support columns includes a first column provided on a front side of said image forming apparatus, a second column provided on a rear side of said image forming apparatus and configured to support said first body duct unit with said first column, a third column provided on the front side and different from said first column, and a fourth column provided on the rear side and configured to support said second body duct unit with said third column, wherein said first fan and said third fan are positioned closer on the rear side than said first column, and wherein said second fan and said fourth fan are positioned closer on the rear side than said third column.

15. An image forming apparatus according to claim 12, wherein said first developing unit, said second developing unit, said third developing unit and said fourth developing unit develop said first photosensitive member, said second photosensitive member, said third photosensitive member and said fourth photosensitive member with toners different colors, respectively.

* * * * *